US011326846B1

(12) United States Patent
Alon et al.

(10) Patent No.: US 11,326,846 B1
(45) Date of Patent: May 10, 2022

(54) MAGAZINE FOLLOWER FOR A FIREARM AND METHOD FOR OPERATING THE FIREARM

(71) Applicant: SARAF EIN GEDI LTD., Poole (GB)

(72) Inventors: Idan Alon, Sapir (IL); Yotam Levy, Kibutz Kfar Haruv (IL); Simon Benchetrit, Ashdod (IL)

(73) Assignee: SARAF EIN GEDI LTD., Poole (GB)

( * ) Notice: Subject to any disclaimer, the term of this patent is extended or adjusted under 35 U.S.C. 154(b) by 0 days.

(21) Appl. No.: 17/364,572

(22) Filed: Jun. 30, 2021

(51) Int. Cl.
*F41A 9/70* (2006.01)

(52) U.S. Cl.
CPC ..... *F41A 9/70* (2013.01)

(58) Field of Classification Search
CPC ..... F41A 9/65; F41A 9/70; F41A 9/71
See application file for complete search history.

(56) References Cited

U.S. PATENT DOCUMENTS

| | | | | |
|---|---|---|---|---|
| 2,895,248 A * | 7/1959 | Sawin | F41A 9/71 | 42/50 |
| 2,997,803 A * | 8/1961 | Florence | F41A 17/38 | 42/18 |
| 4,446,645 A * | 5/1984 | Kelsey, Jr | F41A 9/70 | 42/50 |
| 5,638,626 A * | 6/1997 | Westrom | F41A 9/70 | 42/18 |
| 9,032,655 B2 * | 5/2015 | Spine | F41A 17/36 | 42/49.01 |
| 10,168,116 B1 * | 1/2019 | Jen | F41A 9/67 | |
| 11,054,202 B1 * | 7/2021 | Underwood | F41A 9/71 | |
| 2005/0115128 A1 * | 6/2005 | Hahin | F41A 9/65 | 42/50 |
| 2014/0075810 A1 * | 3/2014 | Mikroulis | F41A 17/36 | 42/50 |

FOREIGN PATENT DOCUMENTS

| | | | | |
|---|---|---|---|---|
| FR | 2966918 A3 * | 5/2012 | F41A 9/70 | |
| WO | WO-2013086416 A1 * | 6/2013 | F41A 15/00 | |
| WO | WO-2016123009 A1 * | 8/2016 | F41A 9/70 | |

OTHER PUBLICATIONS

"AK-47 BHO Follower, WeaponTech, Fits 7.62x39 Magazines, Polymer, US Made 922(r) Compliance Part", APEX Gun Parts, https://www.apexgunparts.com/weapontech-ak47-bho-follower-fits-7-62x39-mags-polymer-new-US-made.html; Retrieved from the Internet on Jun. 30, 2021.

"Auto bolt stop for the AK's"; http://forum.saiga-12.com/index.php?/topic/602-auto-bolt-stop-for-the-aks/; Retrieved from the internet on Jun. 30, 2021.

* cited by examiner

*Primary Examiner* — Gabriel J. Klein
(74) *Attorney, Agent, or Firm* — The Roy Gross Law Firm, LLC; Roy Gross

(57) ABSTRACT

A magazine follower is disclosed. The magazine follower may include: a magazine spring receptacle having, a bullet support surface having a first portion and a second portion, each bullet support portion is shaped to support a bullet in the magazine. Therefore, the second portion protrudes from the first portion. The magazine follower further includes a metallic flange, extending from the first portion and positioned in the front of the bullet support surface, in a direction facing a chamber of a firearm when the magazine follower is assembled in a magazine and the magazine is inserted into the firearm.

9 Claims, 3 Drawing Sheets

MAGAZINE FOLLOWER FOR A FIREARM AND METHOD FOR OPERATING THE FIREARM

FIELD OF THE INVENTION

The present invention relates generally to the field of firearm's magazine. More specifically, the present invention relates to a magazine follower for a firearm's magazine.

BACKGROUND OF THE INVENTION

Firearm's magazines are bullets storage and feeding devices for a repeating firearm. A specific type of magazine used in modern assault rifles, such as, M16 and AK-47 is the detachable box magazine. Assault rifles using detachable magazines are made with an opening known as a magazine well into which the detachable magazine is inserted. The magazine well locks the magazine in position for feeding bullets into the chamber of the rifle, and requires a device known as a magazine release to allow the magazine to be separated from the rifle.

Detachable box magazine includes at least 4 components, a spring, a spring follower, a body and a base. At the end of each firing session, the empty magazine is released from the magazine well and replaced with a new loaded magazine. In order to continue firing, the firearm needs to be reloaded by pressing the bolt release latch if possible or pulling the bolt backwards using the charging handle for re-chambering the firearm.

As for today, there is no solution for the firing in between magazines exchanging, which consume crucial time during battle.

Accordingly, there is a need for a solution allowing keeping a bullet in the firing chamber, ready to be fired during the magazines exchanging.

SUMMARY OF THE INVENTION

Some aspects of the invention may be directed to a magazine follower, comprising: a magazine spring receptacle having, a bullet support surface having a first portion and a second portion, each bullet support portion is shaped to support a bullet in the magazine. In some embodiments, the second portion protrudes from the first portion. The magazine follower further includes a metallic flange, extending from the first portion and positioned in the front of the bullet support surface, in a direction facing a chamber of a firearm when the magazine follower is assembled in a magazine and the magazine is inserted into the firearm.

In some embodiments, the second portion protrudes from the first portion in a height which is determined based on the diameter of the bullet and the width of the magazine.

In some embodiments, the magazine follower may further include, a spring located at the magazine spring receptacle below the second portion and the flange is a movable flange having an extended arm, in contact, at one end, with the spring and configured to slide below the support surface. In some embodiments, the first portion further comprises a recess for accommodating the movable flange.

In some embodiments, the magazine follower may further include, a cover assembled below the support surface covering the movable flange from an inner volume of the follower. In some embodiments, the first portion further comprises a hole configured to receive the tongue of a lock.

In some embodiments, the flange has a sloped edge. In some embodiments, the flange is sloped at an angle of 20-70 degrees.

In some embodiments, the magazine spring receptacle is made from a material having a hardness of at most 130 HRR and the hardness of the flange is between 42 to 47 HRC. In some embodiments, the magazine spring receptacle is made from a polymer selected from: polycarbonate (PC), polydicyclopentadiene (PDCPD), acrylonitrile butadiene styrene (ABS) and reinforced ABS. In some embodiments, the flange is made from a steel grade selected from: SAE 1075, D2, 90-10 and SAE 8160.

In some embodiments, the size of the flange is determined as to allow the flange to stop the bolt from reaching the firing chamber while allowing a bullet to enter the chamber.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1B:
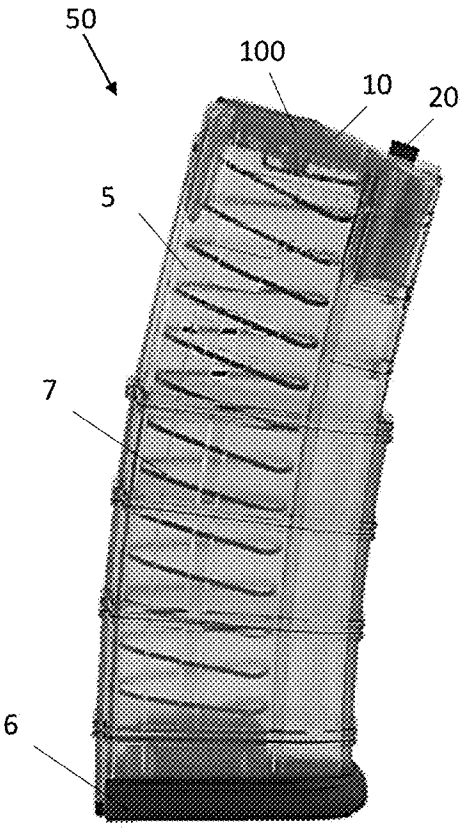
FIGS. 1A and 1B are illustration of a magazine follower and a magazine according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

Some aspects of the invention may be directed to a magazine follower to be inserted into a magazine of a firearm, that may allow loading a bullet (e.g., the last bullet in the magazine) into the firing chamber prior to replacing an empty magazine with a new loaded one. The loaded bullet may allow the user to fire the bullet during or after the insertion of the loaded magazine.

As used herein, a firearm, refers to any repeating firearm that uses detachable box magazine, for example, assault rifles, semi-automatic pistols, automatic pistols and the like.

As used herein, a magazine, refers to a detachable box magazine to be used in a repeating firearm.

As use herein, a bullet, also known in the art as, a round, a projectile, etc., may include any ammunition suitable for loading into a detachable box magazine.

Figure 1A:
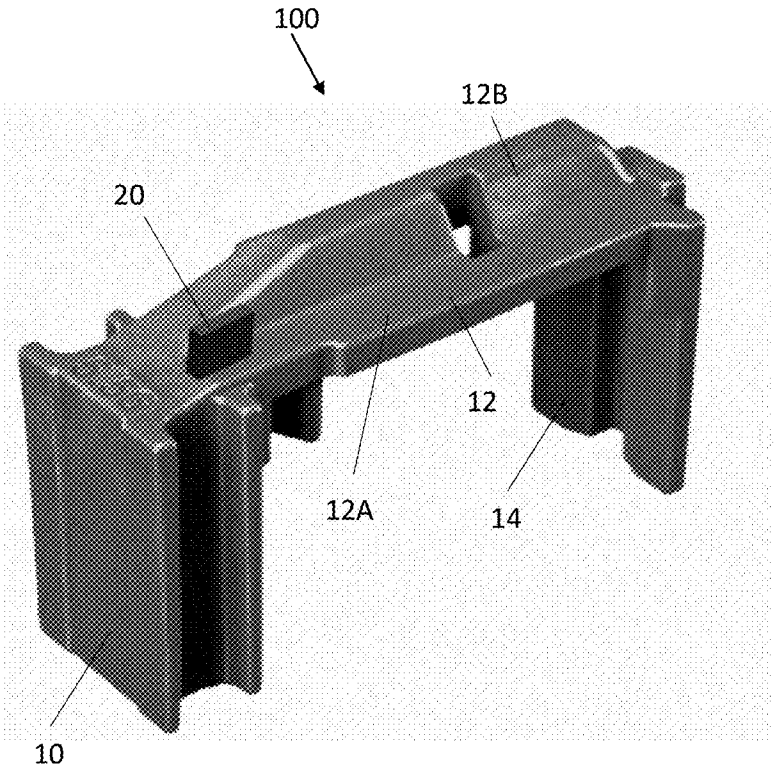

Reference is now made to FIG. 1A which is an illustration of a magazine follower 100 according to some embodiments of the invention. Magazine follower 100 may include a magazine spring receptacle 10 and a metallic flange 20. In some embodiments, magazine spring receptacle 10 may include a bullet support surface 12 having a first portion 12A and a second portion 12B, such that each bullet support portion is shaped to support a bullet in the magazine. In some embodiments, second portion 12B may protrude from first portion 12A. In some embodiments, second portion 12B may protrude from the first portion 12A in a height which may be determined based on the diameter of the bullet and the width of the magazine (e.g., magazine 50 illustrated in FIG. 1B).

In some embodiments, magazine spring receptacle 10 may further include one or more walls 14 for holding a spring, such as, spring 7 illustrated in FIG. 1B. In some embodiments, magazine spring receptacle 10 may be made from, relatively soft material, for example, material having a hardness of at most 130 HRR (Rockwell Hardness R). Some nonlimiting examples, for such materials may be selected from the following polymers, polycarbonate (PC), poly-dicyclopentadiene (PDCPD), acrylonitrile butadiene styrene (ABS), reinforced ABS and the like. In some embodiments, the magazine spring receptacle 10 may be made from a metal.

Metallic flange 20 may extend from first portion 12A and positioned in the front of bullet support surface 12 in a direction facing a chamber of a firearm when magazine follower 100 is assembled in a magazine (e.g., magazine 50) and the magazine is inserted into the firearm. In some embodiments, the size of flange 20 may be determined as to allow the flange to stop the bolt from reaching the chamber so that there is a visual indication that the last bullet in the magazine was drawn into the firing chamber of the firearm while allowing the last bullet to enter the firing chamber.

In some embodiments, metallic flange 20 may be made from a material having hardness of between 42 and 47 HRC (Rockwell Hardness C), for example, high-speed steels, high carbon steels and the like. Some nonlimiting examples for such steels may include steel grade selected from: SAE 1075, D2, 90-10 and SAE 8160.

Reference is now made to FIG. 1B which is an illustration of a magazine 50 that includes a magazine follower 100 according to some embodiments of the invention. Magazine 50 may include a body 5, a spring 7, a base 6 and magazine follower 100 according to embodiments of the invention. In the nonlimiting example illustrated in FIG. 1B, magazine follower 100 is assembled in an M-16 magazine. Accordingly, upon firing the bullet before the last bullet, the last bullet is being placed in the firing chamber, however the bolt is stopped backwards, by flange 20, thus indicating to the user that the magazine is now empty, and allowing releasing of the empty magazine and insertion of the new magazine, while keeping a bullet in the chamber. If the necessary, the bullet left in the firing chamber can be fired prior to the insertion of the new magazine. When a new magazine is inserted into the firearm, firing the last bullet that was drawn into the firing chamber prior to the replacement of the magazine will cause the entire bolt assembly to withdraw and chamber a new bullet from the newly inserted magazine.

Figure 2:
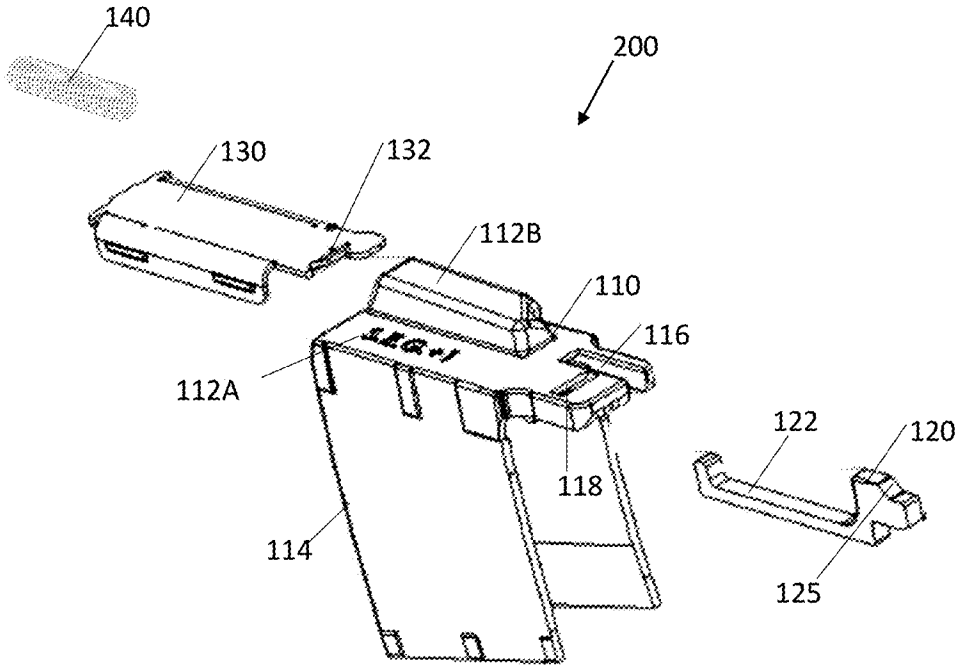
FIG. 2 is an illustration of another magazine follower according to some embodiments of the invention.

Reference is now made to FIG. 2 which is an illustration of another magazine follower 200 according to some embodiments of the invention. Magazine follower 200 may include a magazine spring receptacle 110, a metallic movable flange 120, and a spring 140. In some embodiments, magazine spring receptacle 110 may include a bullet support surface 112 having a first portion 112A and a second portion 112B, similarly to bullet support surface 12 of magazine spring receptacle 10 of FIG. 1. In some embodiments, spring 140 may be located at magazine spring receptacle 110 below second portion 112B.

In some embodiments, metallic movable flange 120 may extend from first portion 112A and be positioned in front of bullet support surface 112 in a direction facing a chamber of a firearm when magazine follower 200 is assembled in a magazine (e.g., magazine 50) and the magazine is inserted into the firearm. In some embodiments, movable flange 120 may have an extended arm 122, connected to or in contact with spring 140 and configured to slide below support surface 112. In some embodiments, first portion 112A of support surface 112 may include a recess 116 for accommodating movable flange 120 allowing movable flange 120 to move forward and backwards while extending from first portion 112A. In some embodiments, movable flange 120 may be made from the same material as flange 20 of FIG. 1A.

In some embodiments, flanges 20 and/or 120 may have a trimmed or sloped edge 125 125, sloping downwards from a first side proximal to portion 12B or 112B and a distal side closer to the firing chamber when the magazine is loaded into the firearm, so that flange 20 or 120 is higher at the proximal side than at the distal side, with respect to portion 12A, 112A, thus allowing the firearm's bolt to slide over the flange when retracting backwards, while allowing flanges 20 and/or 120 to stop the bolt from going forward towards the firing chamber when loading the last bullet in magazine 50. In some embodiment, the flange may be trimmed or sloped at an angle of 20-70 degrees.

In some embodiments, magazine follower 200 may further include a cover 130 assembled below support surface 112 covering the movable flange 120 from an inner volume of magazine follower 200, for example, the volume defined by walls 114. In some embodiments, cover 130 may be secured to walls 114 by any know method, for example, welding, gluing, screwing and the like. In some embodiments, cover 130 may be secured to support surface 112. For example, cover 130 may have a tongue 132 and first portion 112A of support surface 112 may further include a hole 118 configured to receive tongue 132, as illustrated.

Figure 3:
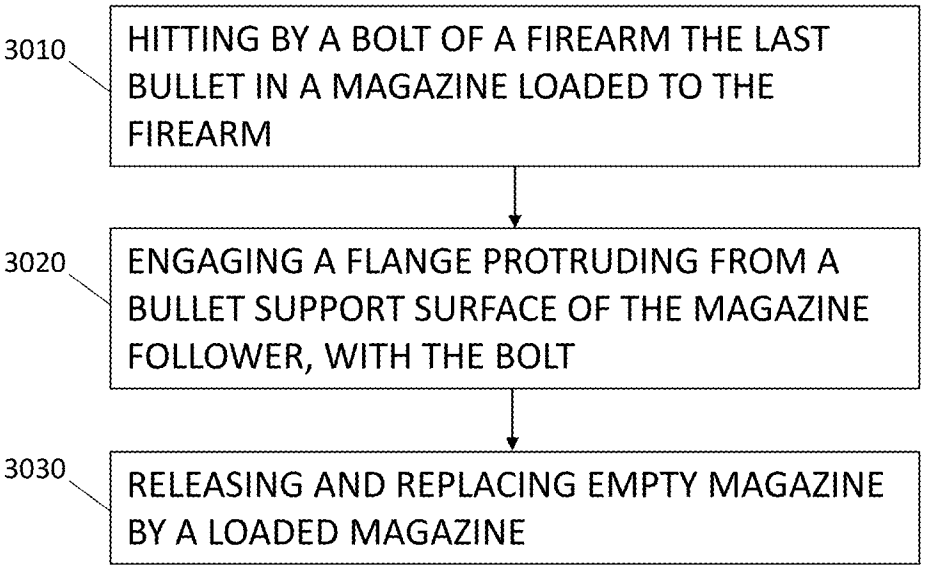
FIG. 3 is a flowchart of a method of reloading a firearm using a follower according to embodiments of the present invention.

Reference is now made to FIG. 3 which is a flowchart of a method of reloading a firearm using a follower according to embodiments of the present invention.

In step 3010, a bolt of a firearm hits the last bullet in a magazine loaded to the firearm, providing to the bullet sufficient kinetic energy to fully enter the firing chamber of the firearm.

In step 3020, the bolt engages a flange protruding from a bullet support surface of the magazine follower. The flange prevents the bolt from reaching the firing chamber, and thus keeping the bolt retracted backwardly, indicating to the user that the last round was drawn into the firing chamber and the magazine is empty.

According to some embodiments, in step 3030, the empty magazine may be released and replaced by a loaded magazine. Once a loaded magazine is inserted into the magazine well, pulling the firearm's trigger will shoot the bullet that was loaded into the firing chamber from the previous magazine, and the retraction and extraction of the bolt would draw a bullet from the newly entered magazine into the firing chamber without the need for manual rechambering.

According to some embodiments, during magazine replacement, when the empty magazine is already removed from the magazine well of the firearm, but a loaded magazine was not yet entered, the firearm may still be usable as there is a single bullet in the chamber of the firearm. It should be appreciated by those skilled in the art that if the bullet in the firing chamber is used prior to entering a full magazine into the magazine well, manual rechambering would be required. It should be further realized that when the magazine is removed from the firearm, the bolt assembly that was prevented by the flange, from moving forward towards the firing chamber may close the gap between the bolt and firing chamber.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. A magazine follower, comprising:

a magazine spring receptacle comprising a bullet support surface having a first portion and a second portion, each of the first portion and the second portion is shaped to support a bullet in the magazine, wherein the second portion protrudes from the first portion;

a metallic flange, extending from the first portion and positioned in the front of the bullet support surface, in a direction facing a chamber of a firearm when the magazine follower is assembled in a magazine and the magazine is inserted into the firearm;

a spring located at the magazine spring receptacle below the second portion, wherein the flange is a movable flange having an extended arm, in contact, at one end, with the spring and configured to slide below the support surface, and wherein the first portion further comprises a recess for accommodating the movable flange; and a cover assembled below the bullet support surface covering the movable flange from an inner volume of the follower.

2. The magazine follower of claim 1, wherein the second portion protrudes from the first portion in a height which is determined based on the diameter of the bullet and the width of the magazine.

3. The magazine follower of claim 1, wherein the cover has a tongue, and wherein the first portion further comprises a hole configured to receive the tongue of a lock.

4. The magazine follower of claim 1, wherein the flange has a sloped edge.

5. The magazine follower of claim 4, wherein the flange is sloped at an angle of 20-70 degrees.

6. The magazine follower of claim 1, wherein the magazine spring receptacle is made from a material having a hardness of at most 130 HRR and the hardness of the flange is between 42 to 47 HRC.

7. The magazine follower of claim 1, wherein the magazine spring receptacle is made from a polymer selected from: polycarbonate (PC), poly-dicyclopentadiene (PDCPD), acrylonitrile butadiene styrene (ABS) and reinforced ABS.

8. The magazine follower of claim 1, wherein the flange is made from a steel grade selected from: SAE 1075, D2, 90-10 and SAE 8160.

9. The magazine follower of claim 1, wherein the size of the flange is determined as to allow the flange to stop the bolt from reaching the firing chamber while allowing a bullet to enter the chamber.

* * * * *